US008071225B2

(12) United States Patent
Hehn

(10) Patent No.: US 8,071,225 B2
(45) Date of Patent: Dec. 6, 2011

(54) DIE CAST ORIFICES WITH PROJECTIONS

(75) Inventor: Rudolf Hehn, Nudlingen (DE)

(73) Assignee: Gardner Denver Deutschland GmbH, Bad Neustadt (DE)

( * ) Notice: Subject to any disclaimer, the term of this patent is extended or adjusted under 35 U.S.C. 154(b) by 370 days.

(21) Appl. No.: 12/138,100

(22) Filed: Jun. 12, 2008

(65) Prior Publication Data

US 2009/0162687 A1 Jun. 25, 2009

(30) Foreign Application Priority Data

Dec. 20, 2007 (DE) ..... 10 2007 062 484

(51) Int. Cl.
*F16S 5/00* (2006.01)
*B22D 17/22* (2006.01)

(52) U.S. Cl. ..... 428/596; 428/579; 428/582; 428/136; 164/397; 415/214.1

(58) Field of Classification Search ..... None
See application file for complete search history.

(56) References Cited

U.S. PATENT DOCUMENTS

| | | | | |
|---|---|---|---|---|
| 954,304 | A | 4/1910 | Kenney | |
| 2,896,495 | A | 3/1957 | Crawford | |
| 3,683,438 | A * | 8/1972 | Tinnerman | 470/18 |
| 3,684,078 | A * | 8/1972 | Nielsen | 198/377.01 |
| 3,703,906 | A | 11/1972 | Tickett | |
| 3,775,790 | A * | 12/1973 | Tinnerman | 470/20 |
| 3,841,371 | A * | 10/1974 | Thurston | 411/276 |
| 4,167,802 | A * | 9/1979 | Rock et al. | 16/249 |
| 4,884,946 | A | 12/1989 | Belanger et al. | |
| 4,895,472 | A * | 1/1990 | Dony et al. | 403/133 |
| 2006/0099072 | A1 | 5/2006 | Lyons | |

FOREIGN PATENT DOCUMENTS

| | | | |
|---|---|---|---|
| DE | 1 826 001 U | | 2/1961 |
| DE | 1 300 202 | | 7/1969 |
| DE | 44 17 281 A1 | | 11/1995 |
| DE | 10 2004 001 254 A1 | | 7/2004 |
| DE | 10 2007 023 192 A1 | | 3/2008 |
| EP | 347949 | * | 12/1989 |
| EP | 1961855 | * | 8/2008 |
| FR | 2720778 | * | 12/1995 |
| FR | 2780906 | * | 1/2000 |
| JP | 11-093928 | * | 4/1999 |

OTHER PUBLICATIONS

E. Brunhuber, Praxis in der Druckgussfertigung (~Practical Die Casting Production) 1980, pp. 178-183.

* cited by examiner

*Primary Examiner* — John J Zimmerman
(74) *Attorney, Agent, or Firm* — Husch Blackwell LLP; James B. Conte

(57) ABSTRACT

The disclosure relates to an industrial die cast component comprising a first side, a second side, said second side having a second side surface, an aperture opening at said second side and through said second side surface, said aperture having a respective first arcuate surface bounding a central portion of the aperture and said aperture having a respective second surface bounding a projecting portion of the aperture, said projecting portion having a closed end and an open end, said open end forming a gap in said first arcuate surface and said projecting portion closed end extending radially beyond said first arcuate surface, wherein said first arcuate surface is constructed to be engaged by a fastener.

1 Claim, 8 Drawing Sheets

DIE CAST ORIFICES WITH PROJECTIONS

BACKGROUND OF DISCLOSURE

1. Field of Disclosure

The present disclosure relates to die cast orifices and a method of casting the same in a housing or other casting. In addition, the disclosure relates to die core pins that are used for the creation of the die cast orifices.

2. Background Art

Often a casting, such as a housing body, has machine threaded holes therein for securing the housing body to another member such as a housing cover. Generally a screw is passed through a machined hole in the cover and screwed into the threaded holes in the housing body, thereby securing the housing cover and housing body together.

SUMMARY OF DISCLOSURE

The present disclosure provides a casting, such as a housing body, with die cast orifices or bores or apertures therein. The orifices have a round shaped central portion and radially projecting portions forming slots, grooves or channels. The orifices can be located on the radial periphery of the housing body.

The die cast apertures are created via a die cast or molding process using a mold having die core pins that have one or more appendages around their periphery. These appendages on the core pins create the radially projecting portions of the apertures. The invention therefore also concerns the method of casting the housing having the described apertures. The invention further concerns the actual core pin and mold used in connection with the casting method.

Although the below detailed disclosure is described as being applicable to blower housings, it is understood that it is applicable to many types of castings; including housings for compressors, pumps, vacuum pumps, motors, gear boxes, transmissions, or other types of industrial housings.

The following description sets forth specific embodiments of the disclosure and is not intended to limit the scope of the disclosure to the specific embodiments described and shown.

DETAILED DISCLOSURE

Figure 1:
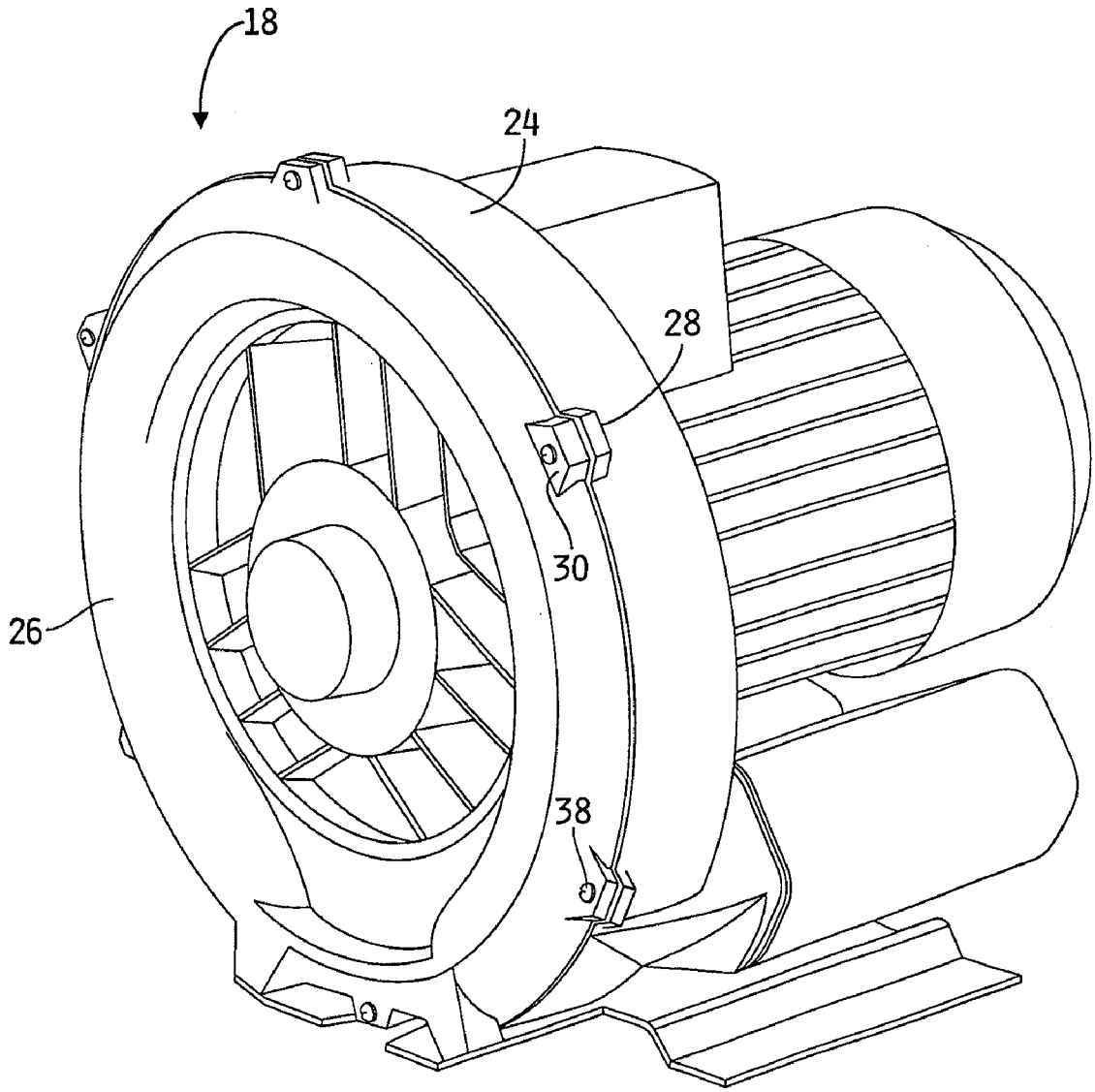
FIG. 1 is a front elevation perspective view of an inventive side channel blower.
Figure 2:
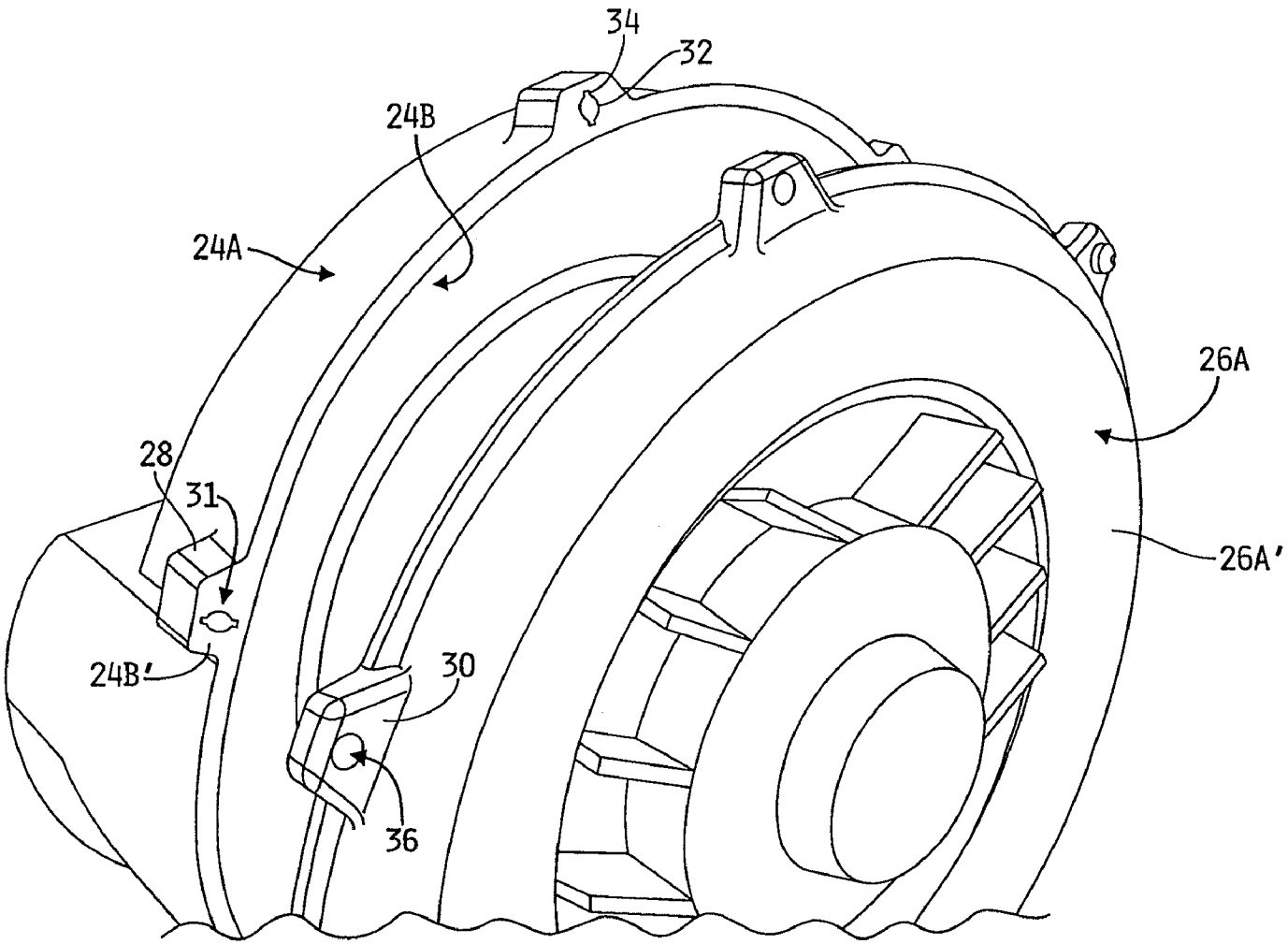
FIG. 2. is a perspective partial view of the blower housing body and housing cover of FIG. 1 before the housing cover is secured to the housing body.
Figure 3:
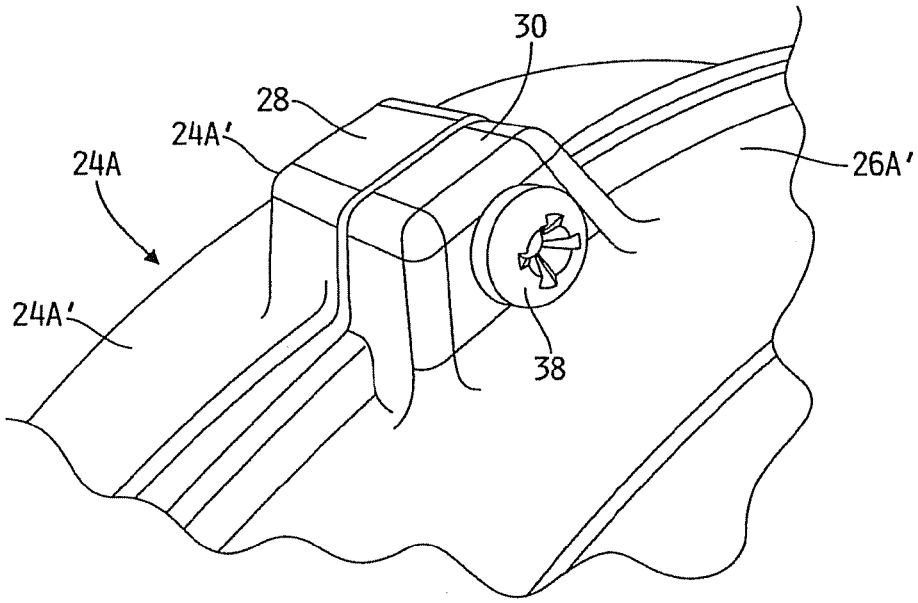
FIG. 3 is a perspective partial view of the blower housing of FIG. 1 after the housing cover is secured to the housing body.

A blower housing 18 includes a housing body 24 and housing cover 26. The housing body 24 has an exterior side 24A and an interior side 24B. The interior side 24B has an interior surface 24B'. The interior surface 24B' bounds cavity 24B". The exterior side 24A has an exterior surface 24A'.

The housing cover 26 has an exterior side 26A. The exterior side 26A has an exterior side surface 26A'. The housing cover 26 and housing body 24 are made of cast metal.

Body 24 includes bosses or projections 28, and cover 26 includes bosses or projections 30. The housing body bosses 28 are located at the circumferential or radial periphery of the housing body 24, and the housing cover bosses 30 are located on the radial or circumferential periphery of housing cover 26. The housing body bosses 28 and cover bosses 30 are located and sized to correspond to one another when connecting respective pairs thereof for joining of the body 24 to the cover 26.

The housing body bosses 28 and cover bosses 30 are trapezoidal shaped with the longer edge radially inward. The trapezoidal shaped housing body bosses 28 and cover bosses 30 extend radially outward. The housing body bosses 28 and cover bosses 30 are sufficiently thick to provide the needed strength and have rounded corners to aid the casting process and reduce stress concentrations.

The number of sets of housing body bosses 28 and corresponding cover bosses 30 can be increased or reduced. The shape of bosses 28 and bosses 30 can also be widely varied, so long as the attachment between cover 26 and body 24 is sufficiently strong. The body attachment bosses 28 and cover attachment bosses 30 may be replaced by corresponding rings formed at the radial circumference of housing body 24 and cover 26.

An orifice or aperture 31 is formed within each housing boss 28. The aperture 31 opens at said interior side 24B and through said interior surface 24B'. The aperture 31 can also open through the exterior surface 24A' and thereby form a through hole. Each aperture 31 has a rounded central portion 32 and radially projecting portions or appendages 34. The radially projecting portions 34 form slots, grooves or channels 34. Each projecting portion 34 extends radially outward from the central portion 32.

Figure 8:
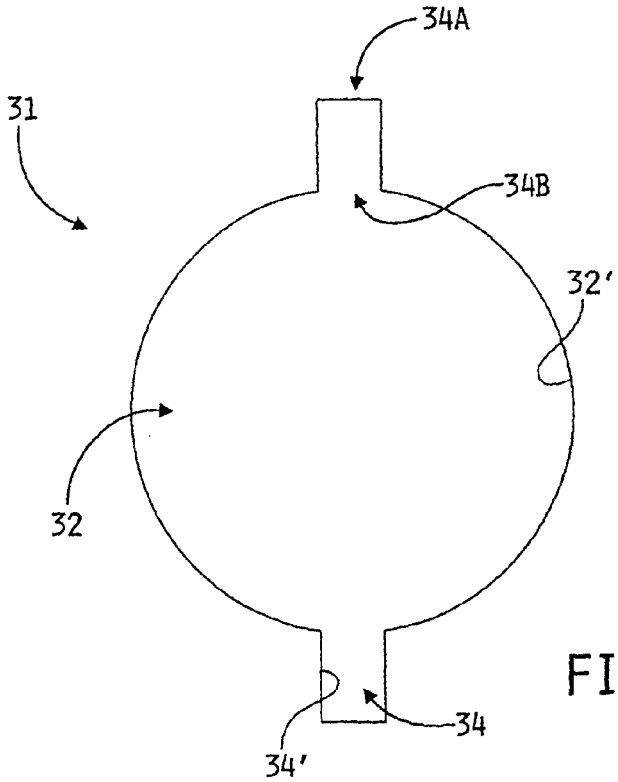
FIG. 8 is a blown up schematic plan view of one of the housing body apertures shown in FIG. 2.
Figure 11:
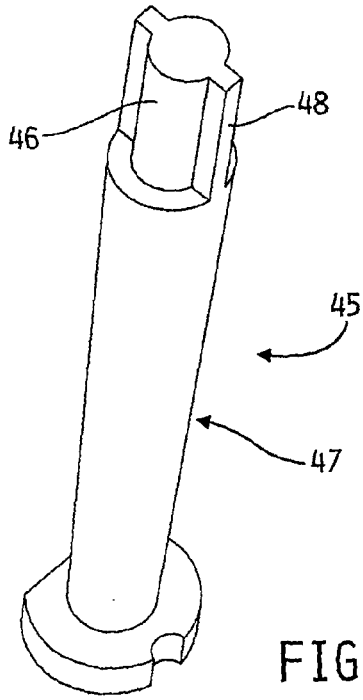
FIG. 11 is a top perspective view of a core pin.

The central portion 32 of each aperture 31 is bounded by arcuate surface 32'. The radially projecting portions 34 of each aperture are bounded by surface 34'. The projecting portions 34 have a closed end 34A and an open end 34B. The open end 34B of each portion 34 forms a gap 34B in said arcuate surface 32' bounding central portion 32. The closed end 34A is radially beyond the arcuate surface 32'. The appendages 34 can extend the axial length of the central portion 32. As can be seen in FIG. 8, each of the gaps 34B traverse an arc length less than the arc length of any continuous portion of arcuate surface 32' adjacent the gap 34B.

A through-going hole or a through-going aperture 36 is located in the center of each cover boss 30.

A self-threading screw 38 can be used to secure the housing body 24 to the housing cover 26 to form the housing 18. The self-threading screw 38 has a head 40 formed at the end of an engagement shaft 42. The cover hole 36 is sized to allow the engagement shaft 42 to pass through it, but not the head 40. The body aperture 31 is sized small enough not to allow the engagement shaft 42 to pass through it unassisted.

Figure 4:
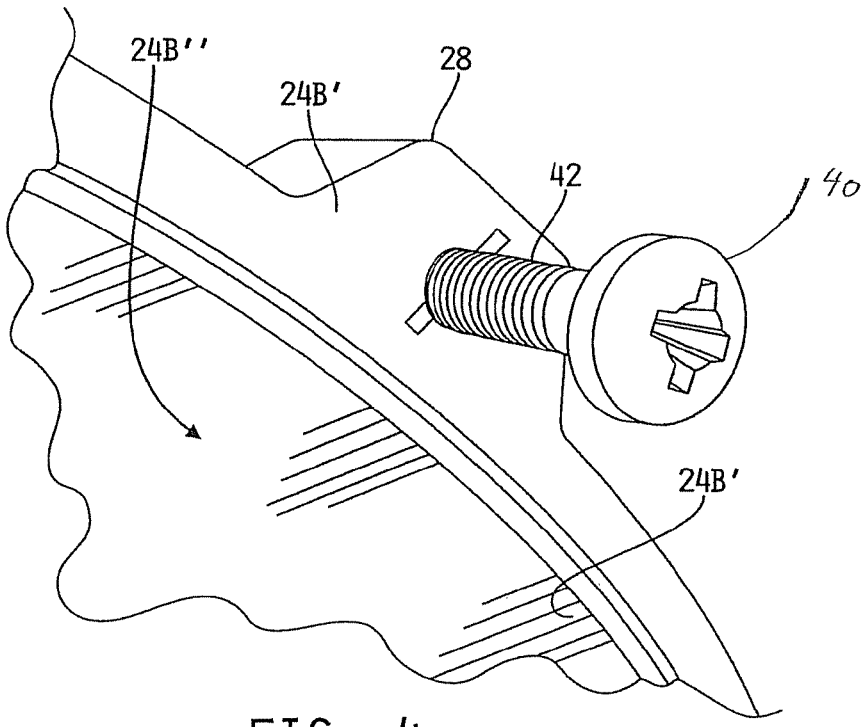
FIG. 4 is a blown-up perspective view of a self-threading screw engaging with the housing body absent the housing cover.
Figure 5:
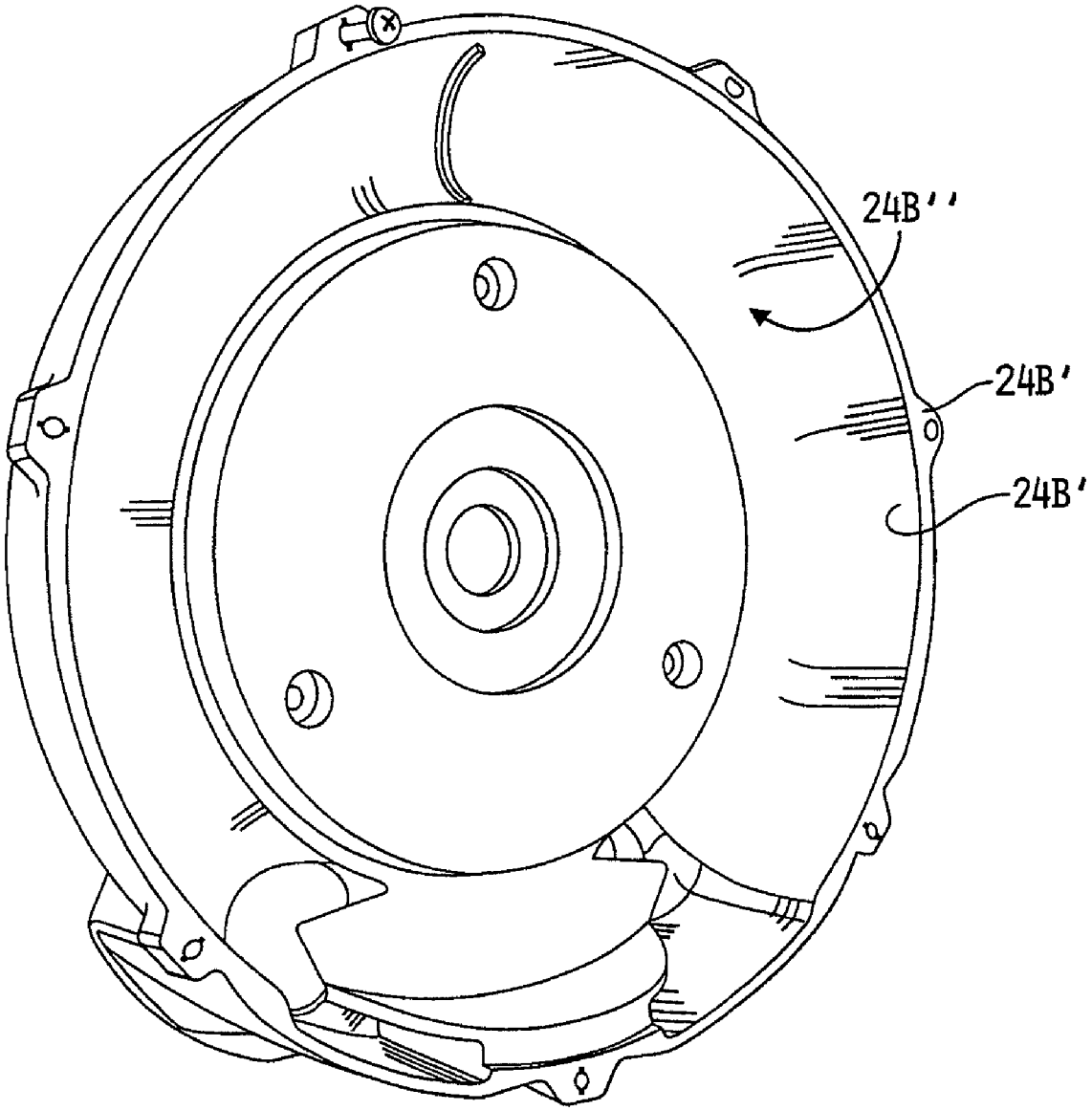
FIG. 5 is a perspective view of the housing body shown in FIG. 4
Figure 6:
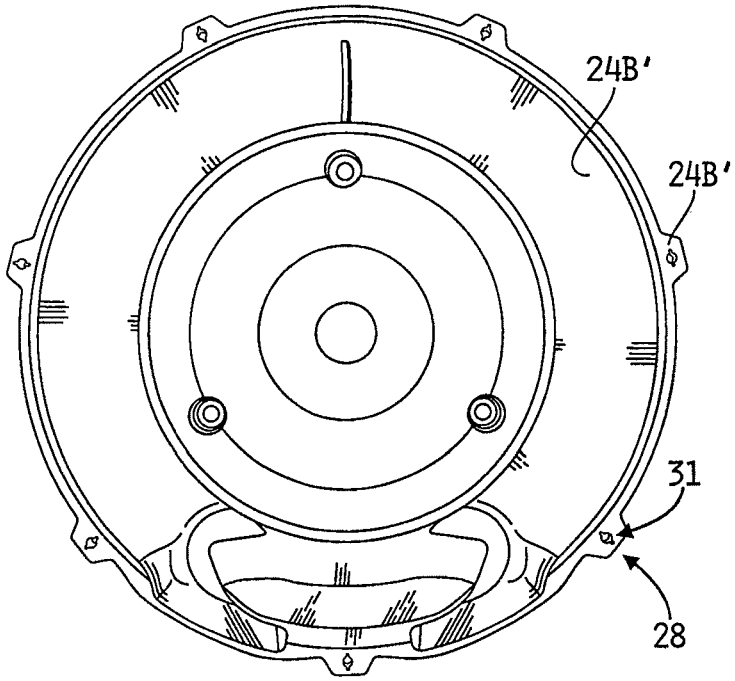
FIG. 6 is a plan view of the housing body shown in FIG. 5.
Figure 7:
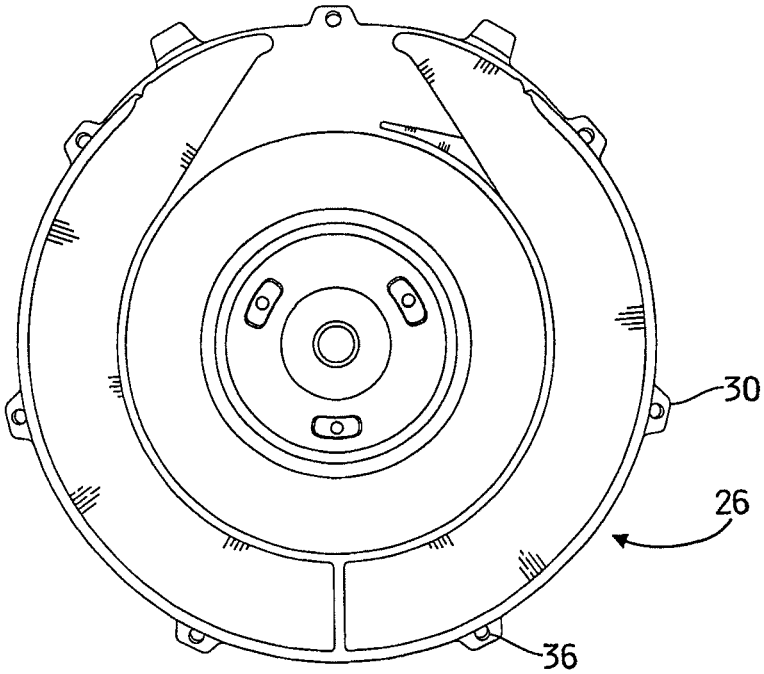
FIG. 7 is a plan view of the interior of the housing cover shown in FIG. 2.

The engagement shaft 42 of the self-threading screw 38 is passed through the cover bore or hole 36 so that the engagement shaft 42 makes contact with the arcuate surface 32' or inner wall 32' of central orifice portion 32. The self-threading screw 38 is then rotated and the engagement shaft 42 cuts a thread into surface 32' and is drawn into the body central orifice 32. FIG. 5 illustrates the self-threading screw 38 being threaded into the body orifice 32 with the housing cover 26 absent for clarity. The process is repeated with multiple body bosses 28 and cover bosses 30 until the housing body 24 is secured to the housing cover 26, as illustrated in FIG. 4. Alternatively, the aperture 31 could be machined to have threading for a bolt. Of course, other fasteners could be used.

Figure 9:
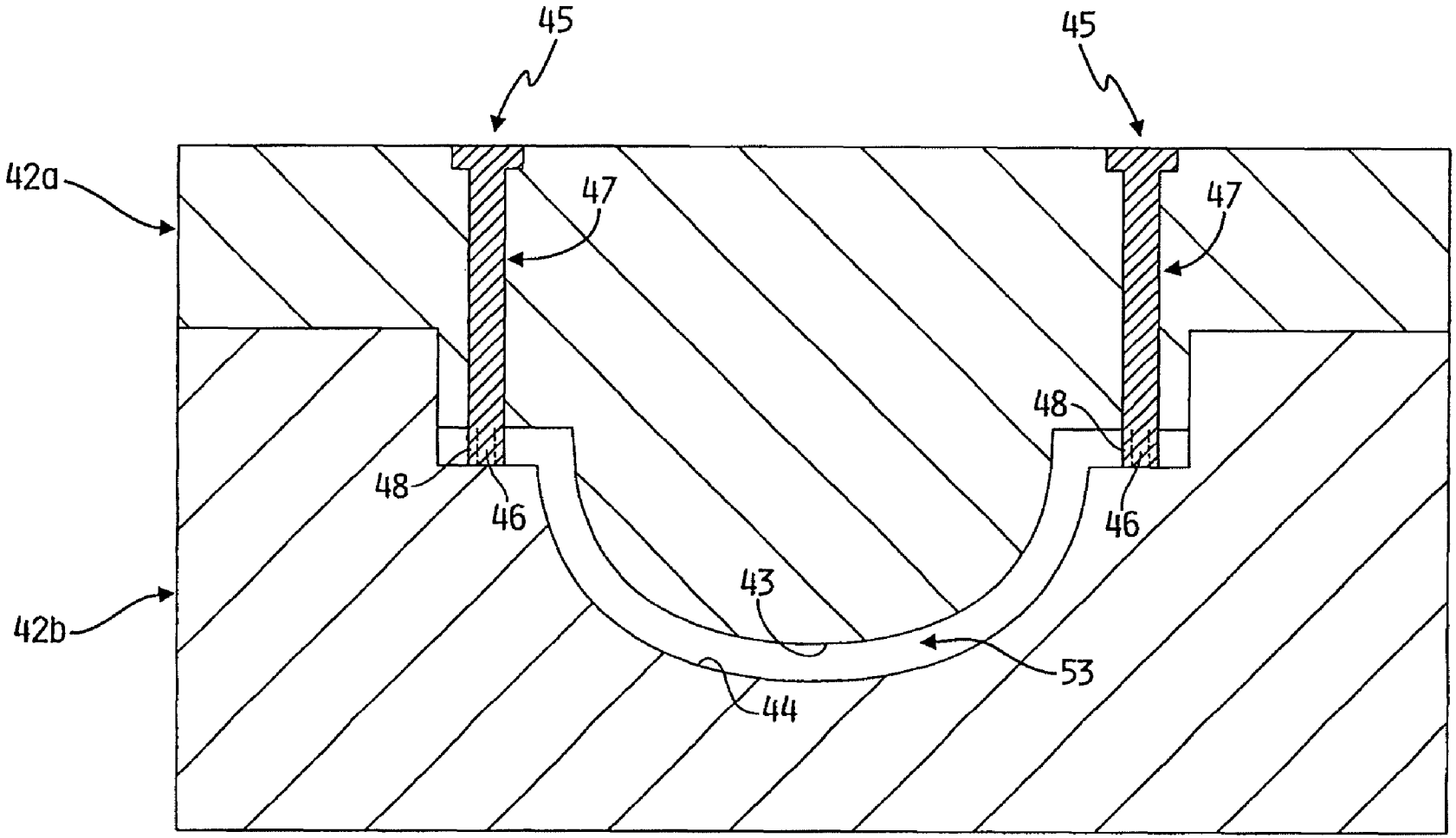
FIG. 9 is a schematic cut through each half of a mold joined together to form the die used to create the housing body.
Figure 10A:
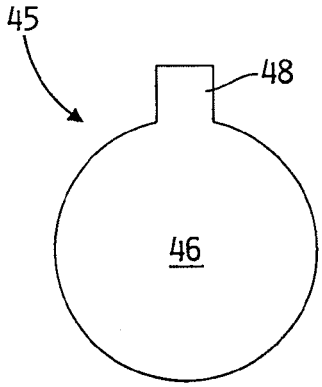
FIG. 10*a* is a top view of a core pin with one squared pin appendage.
Figure 10B:
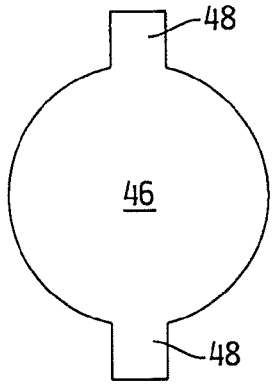
FIG. 10*b* is a top view of a core pin with two squared pin appendages.
Figure 10C:
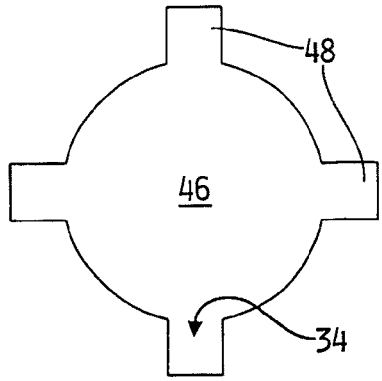
FIG. 10*c* is a top view of a core pin with four squared pin appendages.
Figure 10D:
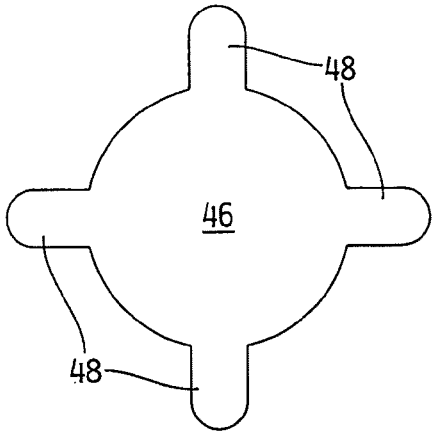
FIG. 10*d* is a top view of a core pin with four rounded pin appendages.
Figure 10E:
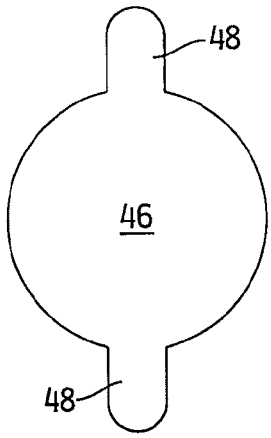
FIG. 10*e* is a top view of a core pin with two rounded pin appendages.
Figure 10F:
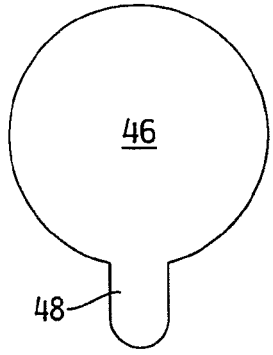
FIG. 10*f* is a top view of a core pin with one rounded pin appendage.

The housing body 24 and body orifices 31 are created using a die casting process. FIG. 9 illustrates die or mold 42 used to manufacture the housing body 24. Die 42 has a first mold half 42*a* and a second mold half 42*b*. The first mold half has a casting surface 43 and the second mold half 42*b* has a casting surface 44. Between the casting surfaces 42*a*, 42*b* is a space 53 wherein material to be cast is disposed by known techniques. The liquid metal takes the shape bounded by surfaces 43 and 44 and hardens to form the housing body 24.

Each core pin 45 has a central portion 46 and an appendage portion 48. The core pin appendages 48 are located on the radial periphery of central portion 46. Each core pin 45 also has an anchor portion 47 to secure each pin 45 in mold half 42*a*. The central portion 46 and appendage portion 48 of each core pin 45 extends from anchor portion 47 of each core pin 45.

The central portion 46 and appendage portion 48 of each core pin 45 form a casting surface. The casting surface 46, 48 of each core pin 45 extends outward from surface 43 and sits in space 53.

The central portion 46 and appendage portion 48 are used to form the body orifices 31 in housing body 24. Accordingly, the body orifices 31 will have a shape defined by the core pins' 45 casting surface 46, 48. The projecting portions 34 will have surfaces 34' that correspond to the shape of the pin appendages 48 external surfaces, and the central round portions 32 will have surfaces 32' that correspond to the shape of core or central portions 46.

FIGS. 10*a* through 10*f* illustrate a variety of pin casting surfaces 46, 48. A single pin appendage 48 may be used, or multiple pin appendages 48 can be used. The pin appendages 48 can have a rounded or squared shape. The figures by no means limit the shape of the casting surfaces 46, 48.

The pin appendages 48 must be large enough and of a design to provide heat dissipation from and support for the core portion 46 to prevent breakage or damage to the core pins 45 during the die casting process. The pin appendages 48 extend the length of the core portion 46 with a uniform shape. Alternatively, the pin appendages 48 may not extend the entire length of the core portion 46. For example, the pin appendages 48 could start at the base 49 of core portion 46 but can stop short of the end wall 51 of the pin. The pin appendages 48 can also taper or have another non-uniform shape.

The use of the core pins is not limited to the creation of the body orifices 31. The core pins 45 can also be used to form an orifice or the like in the cover attachment boss 30 or elsewhere on either the housing body 24 or housing cover 26.

Although the above description is directed to side channel blowers, it is of course understood that the disclosure is applicable to all types of castings. For instance, the use of the core pins 45 with central portions 46 and pin appendages 48 can also be used to create an orifice in a variety of housings including motor housings, compressor housings, etc. Indeed, the core pins 45 with pin appendages 48 described in this disclosure can be used to create an orifice or the like in any die cast component.

Due to the inventive shape of the core pins 45, the section modulus thereof is increased as compared to the section modulus of conventional core pins, thus preventing the core pins 45 from breaking when removed from the mold. Moreover, this enables the core pins 45 to be used for a longer period of time. By means of the conventional core pins, it has so far been impossible to "pre-cast" core holes for mounting threads.

The invention claimed is:

1. An industrial die, core pin and cast component wherein said component comprises:

a first side;

a second side, said second side having a second side surface;

an aperture opening at said second side and through said second side surface;

said aperture having a respective first arcuate surface bounding a central portion of the aperture;

said aperture having a respective second surface bounding a projecting portion of the aperture, said projecting portion having a closed end and an open end, said open end forming a gap in said first arcuate surface, said projecting portion closed end extending radially beyond said first arcuate surface;

wherein said first accurate surface is constructed to be engaged by a fastener;

wherein said component is a blower housing body;

wherein said gap traverses an arc length less than the arc length of any continuous portion of said first arcuate surface adjacent said gap; and wherein said aperture has said core pin therein, said core pin has an amount of appendage in said projection and said core pin extends from said die.

* * * * *

UNITED STATES PATENT AND TRADEMARK OFFICE

CERTIFICATE OF CORRECTION

PATENT NO. : 8,071,225 B2
APPLICATION NO. : 12/138100
DATED : December 6, 2011
INVENTOR(S) : Rudolf Hehn It is certified that error appears in the above-identified patent and that said Letters Patent is hereby corrected as shown below:

Col. 4, line 53, should read

1. An industrial die, core pin and cast component wherein said component comprises:
a first side;
a second side, said second side having a second side surface;
an aperture opening at said second side and through said second side surface;
said aperture having a respective first arcuate surface bounding a central portion of the aperture;
said aperture having a respective second surface bounding a projecting portion of the aperture, said projecting portion having a closed end and an open end, said open end forming a gap in said first arcuate surface, said projecting portion closed end extending radially beyond said first arcuate surface;
wherein said first arcuate surface is constructed to be engaged by a fastener;
wherein said component is a blower housing body;
wherein said gap traverses an arc length less than the arc length of any continuous portion of said first arcuate surface adjacent said gap; and
wherein said aperture has said core pin therein, said core pin has an [[amount of ]]appendage in said projection and said core pin extends from said die.

Signed and Sealed this
Seventh Day of February, 2012

David J. Kappos

David J. Kappos
*Director of the United States Patent and Trademark Office*